US007762043B2

(12) United States Patent
Skarin et al.

(10) Patent No.: US 7,762,043 B2
(45) Date of Patent: Jul. 27, 2010

(54) UNIT FOR APPLYING OPENING DEVICES TO PACKAGES OF POURABLE FOOD PRODUCTS

(75) Inventors: Lars Skarin, Uddevalla (SE); Mahmod Tabarte, Munkedal (SE); Alessandro Morselli, Piumazzo (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 12/162,920

(22) PCT Filed: Dec. 29, 2006

(86) PCT No.: PCT/EP2006/070283

§ 371 (c)(1),
(2), (4) Date: Jul. 31, 2008

(87) PCT Pub. No.: WO2007/087942

PCT Pub. Date: Aug. 9, 2007

(65) Prior Publication Data

US 2009/0025337 A1 Jan. 29, 2009

(30) Foreign Application Priority Data

Jan. 31, 2006 (EP) ..... 06101059

(51) Int. Cl.
*B65B 61/20* (2006.01)
*B31B 1/84* (2006.01)

(52) U.S. Cl. ..... 53/133.2; 53/420; 53/489; 493/87; 493/117

(58) Field of Classification Search ..... 53/133.1, 53/133.2, 420, 421, 485, 489, 287, 329.4, 53/331; 29/798, 818, 793, 822; 493/84, 493/87, 102, 117
See application file for complete search history.

(56) References Cited

U.S. PATENT DOCUMENTS 3,673,663 A * 7/1972 Taddei ..... 29/798

(Continued)

FOREIGN PATENT DOCUMENTS

EP 1 462 370 A1 9/2004

OTHER PUBLICATIONS

PCT/ISA/210 (International Search Report).
Written Opinion.

*Primary Examiner*—Paul R Durand
(74) *Attorney, Agent, or Firm*—Buchanan Ingersoll & Rooney PC

(57) ABSTRACT

A unit (1, 1') for applying opening devices (2, 2') to packages (3) of pourable food products, the unit (1, 1') having first conveying means (8, 8') for feeding the opening devices (2, 2') successively along a first path ($P_1$, $P_1'$); second conveying means (9) for feeding the packages (3) successively along a second path ($P_2$); and transfer means (10) for transferring the opening devices (2, 2') from the first path ($P_1$, $P_1'$) to the second path ($P_2$), and in turn having a wheel (18) rotating about an axis (A), and a number of gripping members (19, 19') carried by the wheel (18) and for receiving respective opening devices (2, 2') from the first conveying means (8, 8') and transferring them to the second path ($P_2$) by rotation of the wheel (18); the transfer means (10) also having connecting means (20) for connecting the gripping members (19, 19') movably to the wheel (18), and cam guide means (21) for altering the position of each gripping member (19, 19') with respect to the wheel (18) as the wheel (18) rotates.

12 Claims, 7 Drawing Sheets

U.S. PATENT DOCUMENTS 4,345,963 A * 8/1982 Braber ..... 156/423
4,523,377 A * 6/1985 Spletzer et al. ..... 29/773
4,548,668 A 10/1985 Roth et al.
5,435,803 A * 7/1995 Owen et al. ..... 493/87
5,467,527 A * 11/1995 Zanini et al. ..... 29/773
6,321,813 B1 * 11/2001 Miyajima et al. ..... 156/497
6,463,715 B1 * 10/2002 Petersson ..... 53/133.2
6,701,692 B1 * 3/2004 Niehr ..... 53/167
2006/0236655 A1 10/2006 Cavilli et al.

* cited by examiner

UNIT FOR APPLYING OPENING DEVICES TO PACKAGES OF POURABLE FOOD PRODUCTS

TECHNICAL FIELD

The present invention relates to a unit for applying opening devices to packages of pourable food products.

BACKGROUND ART

As is known, many pourable food products, such as fruit juice, UHT (ultra-high-temperature treated) milk, wine, tomato sauce, etc., are sold in sealed packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; and the web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are then folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name Tetra Rex (registered trademark).

Once formed, the above packages may undergo further processing, such as the application of a reclosable opening device.

At present, the most commonly marketed opening devices comprise a frame defining a pour opening and fitted about a hole or a pierceable or removable portion of a top wall of the package; and a cap hinged or screwed to the frame, and which is removable to open the package. Alternatively, other types of opening, e.g. slide-open, devices are also known to be used.

The pierceable portion of the package may be defined, for example, by a so-called "prelaminated" hole, i.e. a hole formed in the base layer of the packaging material before covering the base layer with the layer of barrier material, which is therefore whole and closes the hole to ensure airtight, aseptic sealing, while still being easily pierceable.

In the case of aseptic packaging machines, the opening devices described, once formed, are normally applied directly to the packages by on-line application units located downstream from the packaging machine.

Application of the opening devices, e.g. by heat sealing or gluing, involves various preliminary operations on both the packages and the opening devices themselves. More specifically, when the opening devices are applied by heat sealing, both the heat-seal outer layer of the packaging material about the holes or pierceable portions of the packages and the opening devices are partly melted or softened locally by preheating.

Once applied to the respective packages, the opening devices must be held firmly on the packages long enough for the contacting materials to cool and to permit adhesion.

Similarly, when the opening devices are glued on, one or both of the parts for gluing must be coated with adhesive, and the parts must be held firmly in contact with each other long enough to permit adhesion.

Application units are known which substantially comprise two, e.g. chain, conveyors for successively feeding the opening devices and the packages respectively along separate endless paths having respective adjacent parallel portions, along which each opening device is glued to the respective package.

Alternatively, application units are known, e.g. as described in Patent EP-A-1462370, which comprise a first linear step conveyor for feeding a succession of packages along a first, preferably straight, path; a second linear step conveyor for feeding a succession of opening devices along a second straight path extending parallel and in the opposite direction to the first path; and a step-operated carousel conveyor for feeding the opening devices from a pickup station, coincident with one of the stop stations on the second conveyor, to an application station, where the opening devices are applied to the respective packages, and which coincides with one of the stop stations on the first conveyor.

More specifically, the carousel conveyor feeds the opening devices along a circular path, with a vertical axis, through a number of intermediate work stations, where the opening devices are arrested and undergo various preliminary operations before being applied to the respective packages.

In both cases, the versatility of known application units is fairly poor, on account, for example, of the opening device feed rate to the application unit necessarily having to match the package feed rate to the unit. Which means the speed of the application unit is dictated by the longest operation performed on both the opening devices and the packages.

Moreover, both known types of unit are extremely bulky, and have several parts that are accessible only with difficulty by the operator.

DISCLOSURE OF INVENTION

It is an object of the present invention to provide a unit for applying opening devices to packages of pourable food products, designed to provide a straightforward, low-cost solution to the aforementioned drawbacks typically associated with known units.

According to the present invention, there is provided a unit for applying opening devices to packages of pourable food products, comprising:

first conveying means for feeding said opening devices successively along a first path;

second conveying means for feeding said packages successively along a second path; and transfer means for transferring said opening devices from a pickup station located along said first path, to an application station for applying the opening devices to respective said packages and located along said second path; said transfer means comprising a wheel rotating about an axis, and at least one gripping member carried by said wheel and for receiving one opening device at a time from said first conveying means, and transferring it to said second path by rotation of said wheel;

characterized in that said transfer means also comprise connecting means for connecting said gripping member movably to said wheel; and guide means for altering the position of said gripping member with respect to said wheel as the wheel rotates.

BRIEF DESCRIPTION OF THE DRAWINGS

Two preferred, non-limiting embodiments of the present invention will be described by way of example with reference to the accompanying drawings, in which.

BEST MODE FOR CARRYING OUT THE INVENTION

Figure 1:
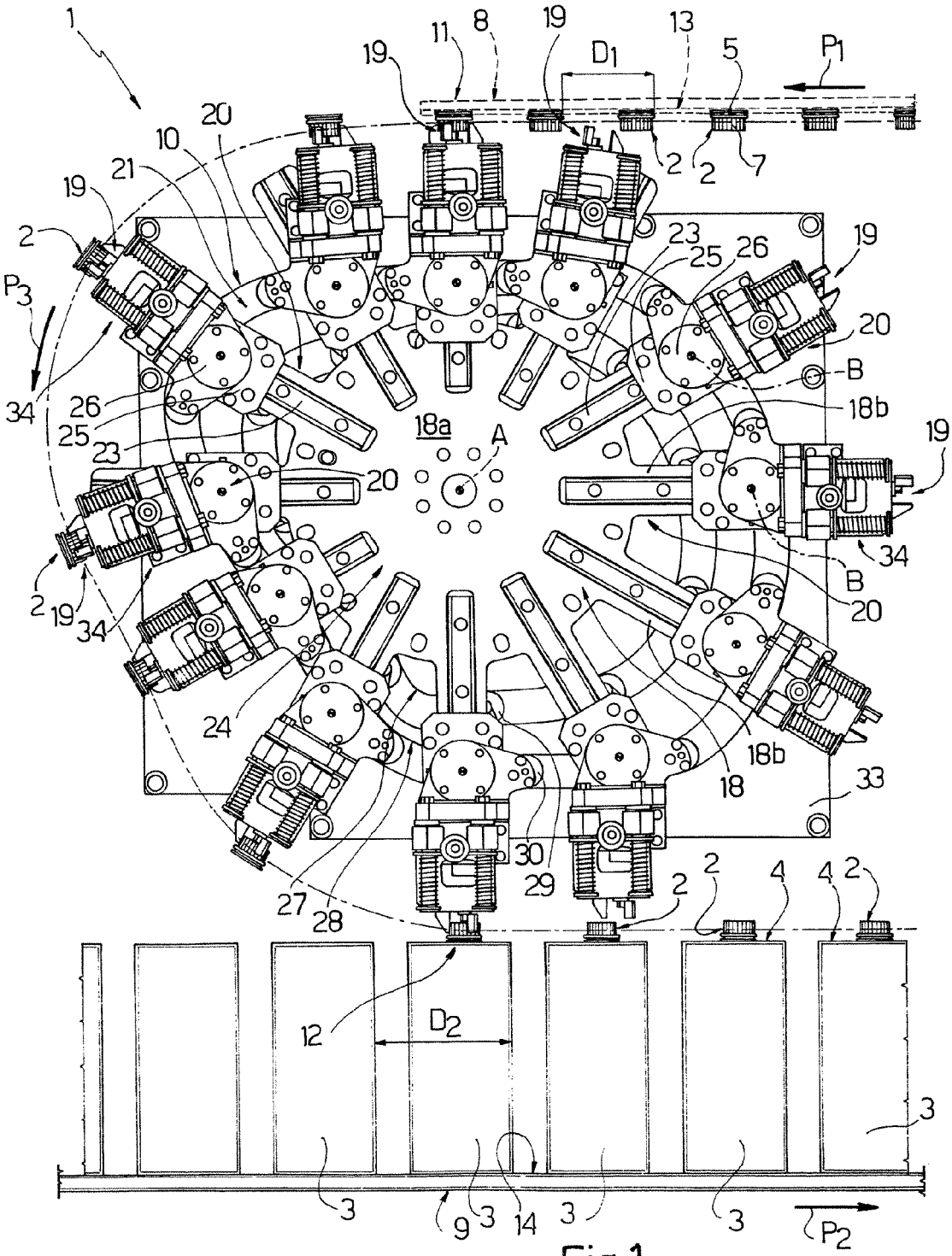
FIG. 1 shows a front view, with parts removed for clarity, of a unit in accordance with the present invention for applying opening devices to packages of pourable food products.

Number 1 in FIG. 1 indicates as a whole a unit for applying opening devices 2 to sealed packages 3 of pourable food products.

Packages 3 are produced upstream from unit 1, as described previously, from sheet packaging material comprising a base layer, e.g. of fibrous material such as cardboard, or of mineral-filled polypropylene material; and a number of layers of heat-seal plastic material, e.g. polyethylene film, covering both sides of the base layer. In the case of aseptic packages 3 for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of package 3 eventually contacting the food product.

Each package 3, which is substantially parallelepiped-shaped in the example shown, has, on an end wall 4, an opening or a pierceable or removable portion (not shown), which is covered outwardly by a respective opening device 2 applied to package 3 by unit 1.

More specifically, opening devices 2 in FIGS. 1, 2, 3, 5 and 6 are screw types made of plastic material, and each comprise in known manner an annular, externally threaded frame 5, which is fixed to wall 4 of a respective package 3 and defines a through opening 6 by which to pour out the food product; and an internally threaded cap 7 screwed to frame 5 to close opening 6. Opening devices 2 may also comprise, in known manner, means (not shown) for piercing the pierceable portion or removing the removable portion of package 3 when unsealing the package.

With reference to FIG. 1, unit 1 substantially comprises a first linear conveyor 8, known and only shown schematically, for feeding a succession of opening devices 2 along a straight horizontal path $P_1$; a second linear conveyor 9, also known and only shown schematically, for feeding a succession of packages 3 along a straight horizontal path $P_2$ parallel and in the opposite direction to path $P_1$ in the example shown; and a transfer conveyor wheel 10 for feeding opening devices 2 from a pickup station 11 located along path $P_1$, to an application station 12 located along path $P_2$ and for applying opening devices 2 to respective packages 3.

Conveyor 8 defines, at least close to pickup station 11, a horizontal conveying surface 13, on which opening devices 2 are positioned with caps 7 downwards facing conveyor wheel 10.

As they travel along conveyor 8, opening devices 2 are coated on the upward-facing side, i.e. opposite the side facing conveyor wheel 10, with adhesive, preferably by means of guns (not shown) located along path $P_1$.

Conveyor 9 is located below conveyor 8, and defines, at least close to application station 12, a horizontal conveying surface 14, on which packages 3 stand with respective walls 4, to which opening devices 2 are eventually applied, positioned horizontally on top, facing conveyor wheel 10.

In the example shown, the spacing $D_1$ of opening devices 2 along conveyor 8 is different from, and more specifically smaller than, the spacing of $D_2$ of packages 3 along conveyor 9; the term "spacing" being used in the sense of the distance between corresponding points of two adjacent opening devices 2 or two adjacent packages 3.

Conveyor wheel 10 rotates continuously about a horizontal axis A perpendicular to paths $P_1$ and $P_2$, and feeds opening devices 2 along a curved path $P_3$ from pickup station 11 to application station 12.

Conveyor wheel 10 substantially comprises a wheel 18 of axis A; and a number of gripping members 19 equally spaced about axis A and fitted to and projecting radially from wheel 18.

Unit 1 advantageously also comprises a number of connecting assemblies 20 for connecting respective gripping members 19 movably to wheel 18; and cam guide means 21 for altering the position of each gripping member 19 with respect to wheel 18 as wheel 18 rotates. The spacing of opening devices 2 along path $P_3$ can thus be adjusted as required to adapt it to the requirements of specific operations to be performed on opening devices 2 (as explained in detail below), and to make it equal to spacing $D_2$ of packages 3 at application station 12.

With reference to FIGS. 1, 2, 3, 5 and 6, connecting assemblies 20 comprise a number of guide members 23 extending radially about axis A and fixed to and projecting from an end surface 24 of wheel 18; and a number of slide members 25 fitted in sliding manner to respective guide members 23, and each supporting a respective gripping member 19.

More specifically, wheel 18 has a central disk-shaped portion 18*a*, from which project peripherally a number of radial projections 18*b*, each fitted with a respective guide member 23.

Each gripping member 19 is fitted to a plate 26, which is hinged to respective slide member 25, on the opposite side to respective guide member 23, and about a respective axis B parallel to axis A and perpendicular to plate 26.

Each gripping member 19 can therefore translate with respect to wheel 18 in a given radial direction with respect to axis A, and can oscillate with respect to wheel 18 about a respective axis B perpendicular to and incident with said radial direction.

As shown in FIG. 1, guide means 21 comprise two curved fixed cams 27, 28 extending seamlessly about axis A and cooperating with respective idle cam follower rollers 29, 30 fitted to slide member 25 and plate 26, respectively, of connecting assembly 20 of each gripping member 19.

More specifically, cams 27, 28 are defined by respective contoured grooves formed in a fixed vertical wall 33 located behind wheel 18 with reference to FIG. 1, or, more specifically, positioned facing an end surface of wheel 18 opposite end surface 24. All parts of cam 28 are located radially outwards of cam 27.

Cam 27 controls the radial position of gripping members 19 with respect to axis A as wheel 18 rotates, while cam 28 controls the orientation of gripping members 19, and therefore of opening devices 2, with respect to the radius of wheel 18 to which they are fixed.

As shown in FIG. 1, gripping members 19, and therefore opening devices 2, change position with respect to wheel 18 as wheel 18 rotates, thus altering their peripheral speed. Which change in position between pickup station 11 and application station 12 provides for adapting the spacing of opening devices 2 to that ($D_2$) of packages 3.

With reference to FIGS. 1, 2, 3 and 5, each gripping member 19 is fixed to respective plate 26 by a supporting frame 34 projecting from plate 26 on the opposite side to respective slide member 25.

More specifically, each frame 34 comprises a main body 35 which is substantially L-shaped in a plane perpendicular to respective plate 26, and is defined by a first plate portion 36 fixed parallel to and against plate 26, and by a second plate portion 37 projecting perpendicularly from plate portion 36, on the opposite side to respective slide member 25. Each frame 34 also comprises two pins 38 extending from a free end of relative plate portion 37 in a direction parallel to and facing relative plate portion 36; and a fastening body 39 which is fitted integrally with relative gripping member 19, is fitted in sliding manner to pins 38, and is loaded elastically, by helical springs 40 coaxial with respective pins 38, into a first withdrawn operating position, i.e. at a minimum radial distance from axis A with reference to the specific radial position occupied by relative slide member 25 along relative guide member 23.

More specifically, fastening body 39 of each frame 34 comprises a main plate portion 43 extending parallel to relative plate 26 and to plate portion 36 of relative main body 35, and from which relative gripping member 19 projects on the opposite side to that adjacent to relative plate portion 37; and an appendix 44 which extends perpendicularly from the end of main portion 43 adjacent to plate portion 37, and defines two through holes engaged in sliding manner by respective pins 38.

Figure 2:
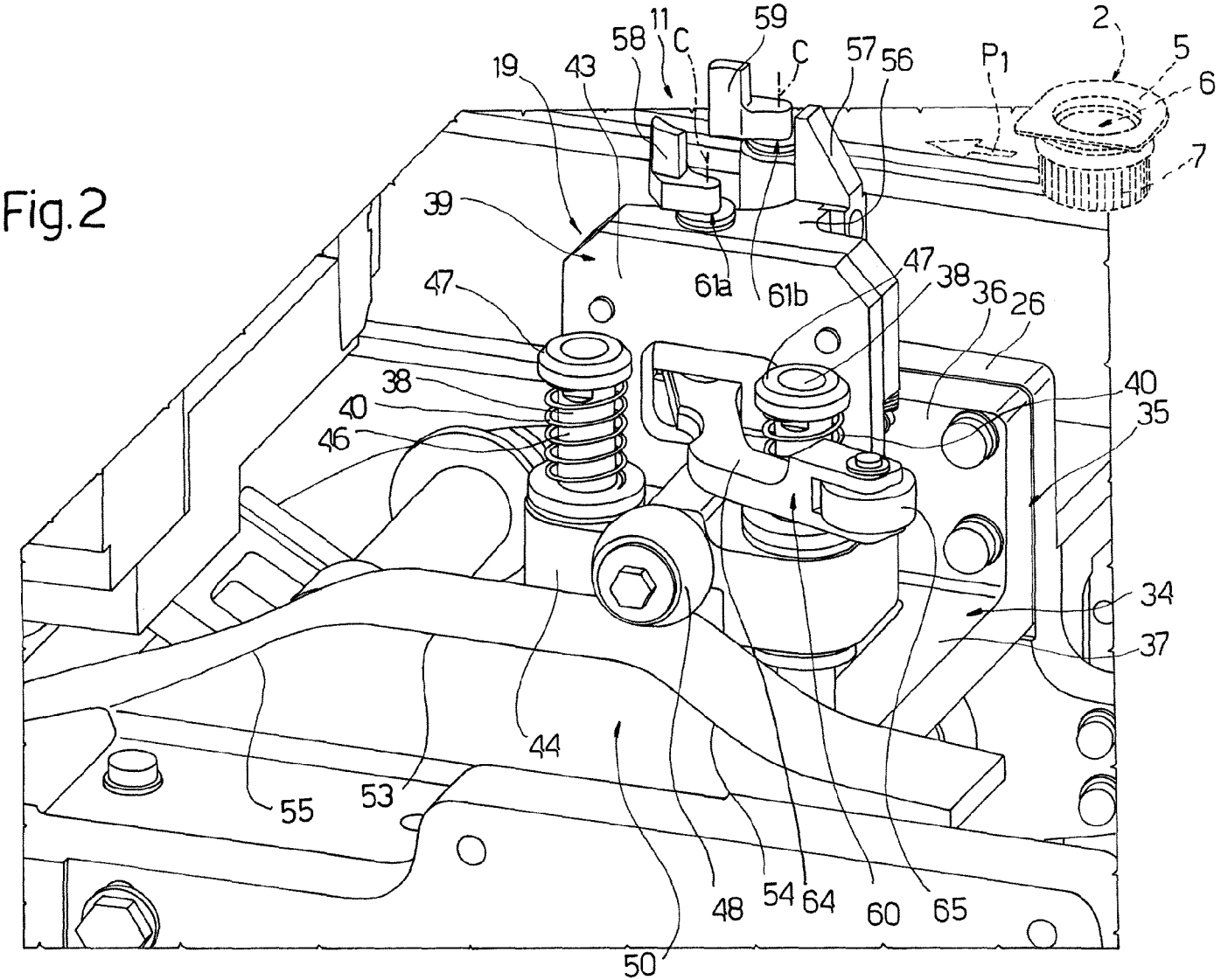
FIG. 2 shows a larger-scale first view in perspective of a gripping member of the FIG. 1 unit for feeding a respective opening device to the area of application to a respective package.
Figure 3:
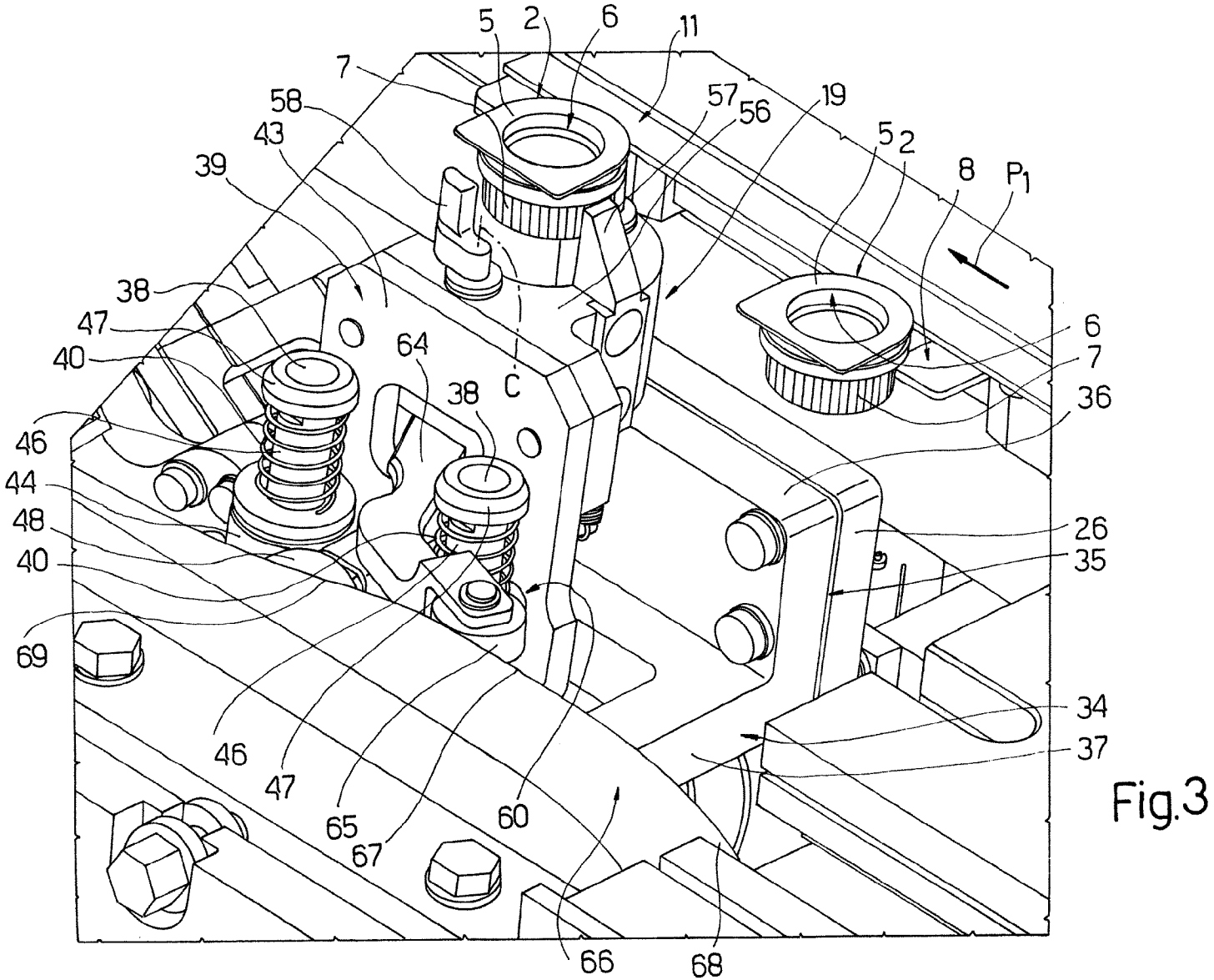
FIG. 3 shows a second view in perspective of the FIG. 2 gripping member.

As shown in FIGS. 2 and 3, pins 38 of each frame 34 extend through relative appendix 44, and have respective portions 46 projecting from appendix 44 and facing relative main portion 43. Each portion 46 is wound externally with a respective spring 40 interposed between relative appendix 44 and an annular end shoulder 47 of portion 46.

A cam follower roller 48 is fitted to and projects from appendix 44 of each frame 34, on the opposite side to relative main portion 43, and cooperates in rolling manner with two fixed cams 50 (shown in FIGS. 2 and 5) located respectively at stations 11 and 12.

Figure 5:
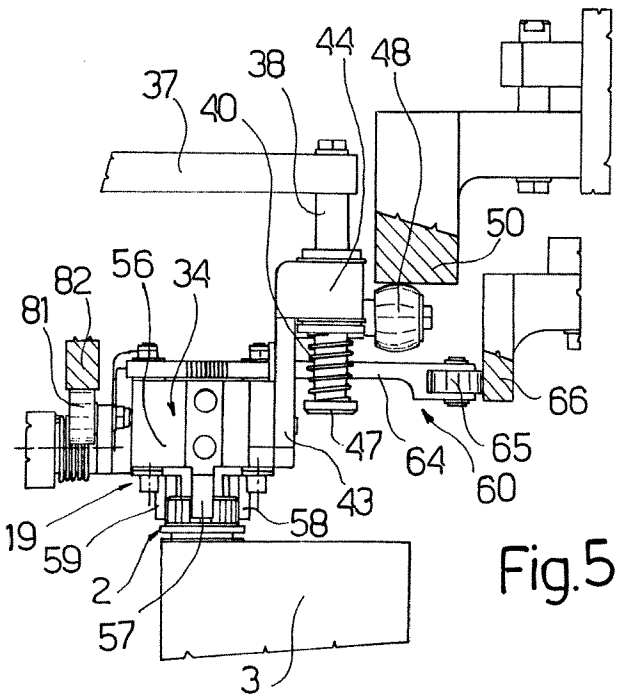
FIG. 5 shows a side view, with parts removed for clarity, of a portion of the FIG. 1 unit.

With reference to FIGS. 2 and 5, cams 50 are located on the opposite side of wheel 18 to vertical wall 33 supporting cams 28, 29, and each comprise a top portion 53 projecting radially outwards with respect to axis A, and from which extend respective oppositely-inclined ramp portions 54, 55. With reference to the rotation direction of wheel 18, ramp portion 54 of each cam 50 slopes upwards towards relative top portion 53, and ramp portion 55 slopes downwards from top portion 53. As each cam follower roller 48 rolls along each cam 50, relative gripping member 19 is first moved from the first withdrawn operating position to a second forward operating position, reached at top portion 53 of cam 50, and then returns to its original position.

In the second forward operating position, each gripping member 19 is located a maximum radial distance from axis A with reference to the radial position occupied by relative slide member 25 along relative guide member 23. Pickup and release of opening devices 2 by gripping members 19 are performed respectively in said second operating position.

With particular reference to FIGS. 2 and 3, each gripping member 19 comprises a supporting body 56 fixed to and projecting from the end of main portion 43 of relative fastening body 39 opposite the end from which relative appendix 44 extends; and three jaws 57, 58, 59 projecting from the radially outermost side of supporting body 56 with respect to axis A, and for gripping a relative opening device 2. One of the jaws (57) is fixed to supporting body 56, while the other two (58, 59) oscillate about respective axes C perpendicular to axis A and to plate portion 37 of relative frame 34.

As shown in FIG. 3, when gripping relative opening device 2, jaws 57, 58, 59 of each gripping member 19 are equally spaced angularly about opening device 2.

More specifically, jaws 58, 59 of each gripping member 19 are loaded elastically into a closed position retaining relative opening device 2 between them and against fixed jaw 57, and are movable selectively, at stations 11 and 12, into an open position in which they are parted to permit engagement and release of opening device 2.

Figure 4:
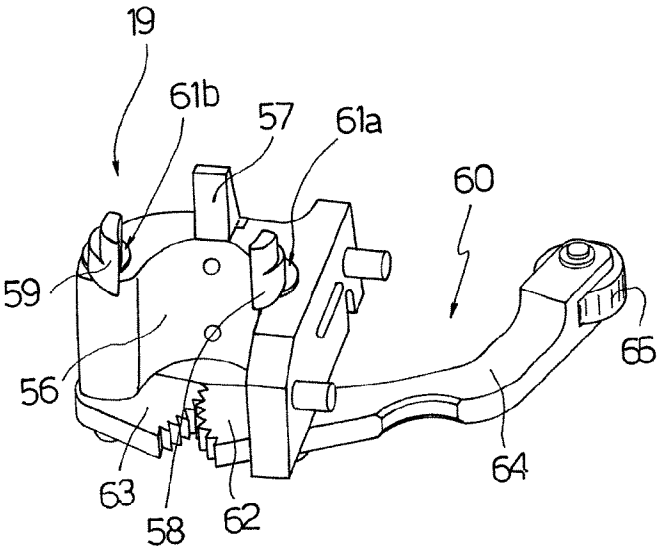
FIG. 4 shows a smaller-scale view in perspective of an actuating mechanism for operating the FIGS. 2 and 3 gripping member.

The movements of jaws 58, 59 of each gripping member 19 are controlled by a lever-and-cam actuating mechanism 60 shown in detail in FIGS. 3 and 4.

Actuating mechanism 60 comprises two pins 61*a*, 61*b* fitted in axially fixed and rotary manner through respective through holes in supporting body 56 of relative gripping member 19, and the opposite ends of which, projecting from supporting body 56, are fitted respectively with respective jaws 58, 59 and respective sector gears 62, 63 meshing with each other. One of the sector gears (62) defines an end portion of a respective lever 64, the other end portion of which is fitted with an idle cam follower roller 65 which cooperates in rolling manner with two fixed cams 66 (shown in FIGS. 3 and 5) located respectively at stations 11 and 12.

Cams 66 are located on the opposite side of wheel 18 to vertical wall 33 supporting cams 28, 29, and each comprise a top portion 67 projecting towards wheel 18 and from which extend respective oppositely-inclined ramp portions 68, 69. With reference to the rotation direction of wheel 18, ramp portion 68 of each cam 66 slopes upwards towards relative top portion 67, and ramp portion 69 slopes downwards from top portion 67.

As each cam follower roller 65 rolls along each cam 66, relative lever 64 is first rotated about the axis of relative pin 61*a*, thus moving jaws 58, 59 simultaneously into the open position, reached at top portion 67, and then rotates in the opposite direction to restore jaws 58, 59 to the closed position.

Figure 7:
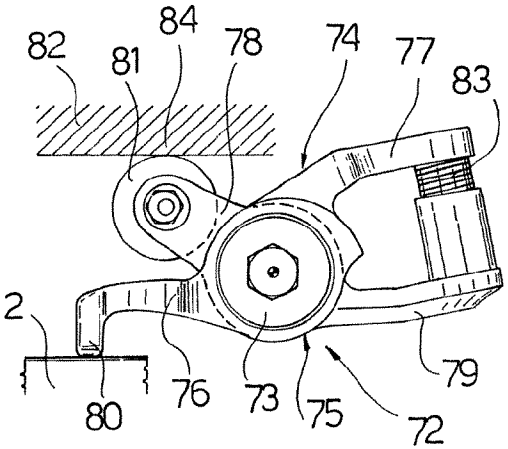
FIG. 7 shows a side view of a pressure member of the FIG. 6 device.
Figure 6:
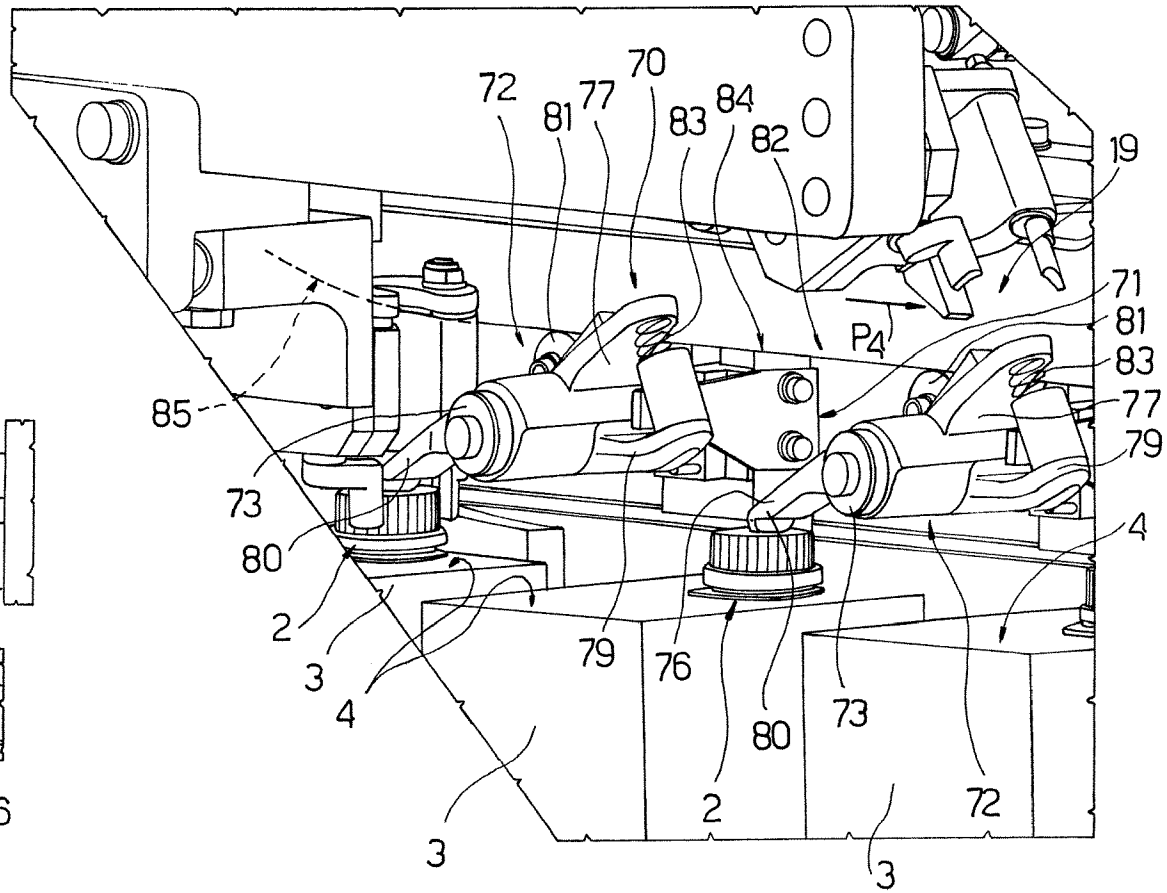
FIG. 6 shows a view in perspective of a pressure device of the FIG. 1 unit for pressing the opening devices on the respective packages pending complete adhesion.

With reference to FIGS. 5, 6 and 7, unit 1 also comprises a pressure device 70 which acts on opening devices 2, as of application station 12 and along a portion of path $P_2$, to hold them firmly on respective packages 3 pending complete adhesion.

Pressure device 70 comprises a known conveyor 71 (shown only partly) for feeding a number of pressure members 72 along a straight path $P_4$ parallel to and facing path $P_2$ and interposed between path $P_2$ and path $P_1$. Pressure members 72 are spaced with the same spacing as spacing $D_2$ of packages 3, and exert pressure on respective opening devices 2 as soon as they are applied to packages 3.

Each pressure member 72 substantially comprises a pin 73 integral with conveyor 71; and two rocker arm levers 74, 75 hinged to pin 73 and comprising respective pairs of arms 76, 77 and 78, 79 arranged in the form of an X about pin 73. More specifically, with reference to the travelling direction of pressure members 72 along path $P_4$, arms 76, 78, located upstream from relative pin 73, of levers 74, 75 of each pressure member 72 define, respectively, a pressure finger 80 acting on relative opening device 2, and a cam follower roller 81 cooperating in rolling manner with a relative fixed cam 82; whereas the free ends of arms 77, 79, located downstream from relative pin 73, of levers 74, 75 define respective seating surfaces for a helical spring 83 for keeping relative cam follower roller 81 in contact with cam 82.

As shown in FIG. 6, cam 82 comprises a main portion 84 extending from application station 12, and which is straight and parallel to paths $P_2$ and $P_4$, and is located at such a distance from opening devices 2, applied to respective packages 3, as to bring pressure fingers 80 into contact with opening devices 2. Cam 82 also comprises, upstream from application station 12, a ramp portion 85 sloping downwards towards packages 3 to move pressure fingers 80 of pressure members 72 from a position fully detached from packages 3, to the position contacting opening devices 2 applied to packages 3.

Operation of unit 1, which is already partly obvious from the foregoing description, will now be described with reference to one opening device 2, and as of the instant in which opening device 2, already coated with adhesive, travels through pickup station 11.

The gripping member 19 to receive opening device 2 is set to the best pickup position by cam follower rollers 29, 30 interacting with respective cams 27, 28, and is also set by cam 27 to the desired radial position, with respect to axis A, corresponding to a specific peripheral speed. The peripheral speed of gripping members 19 at pickup station 11 is preferably greater than the travelling speed of opening devices 2, so as to minimize impact between gripping members 19 and opening devices 2.

On reaching pickup station 11, gripping member 19 is moved towards path $P_1$ of opening devices 2 into the second forward operating position by its own cam follower roller 48 interacting with relative cam 50, and jaws 58, 59 are rotated into the open position by cam follower roller 65 of lever 64 interacting with relative cam 66.

Next, jaws 58, 59 of gripping member 19 are closed about relative opening device 2, and gripping member 19 is withdrawn from path $P_1$ back into the first withdrawn operating position.

The position and travelling speed of gripping member 19 along path $P_3$ are determined by cam follower rollers 28, 29 interacting with cams 27, 28, and, along path $P_3$, the spacing of opening devices 2 is made equal to spacing $D_2$ of packages 3.

Close to application station 12, cam follower roller 48 of gripping member 19 interacts with relative cam 50 to move gripping member 19 back into the second forward operating position; and, at the same time, cam follower roller 65 of lever 64 interacts with relative cam 66 to rotate jaws 58, 59 into the open position to release opening device 2 once it is deposited on respective package 3. A relative pressure member 72 is moved, by its cam follower roller 81 interacting with cam 82, into the position in which pressure finger 80 is brought into contact with opening device 2 to hold it on respective package 3 pending adhesion.

By means of a few straightforward alterations described below, unit 1 can be converted to a unit 1' (FIGS. 8-11) designed to operate with opening devices 2' of a different type and fed differently to unit 1'.

Figure 8:
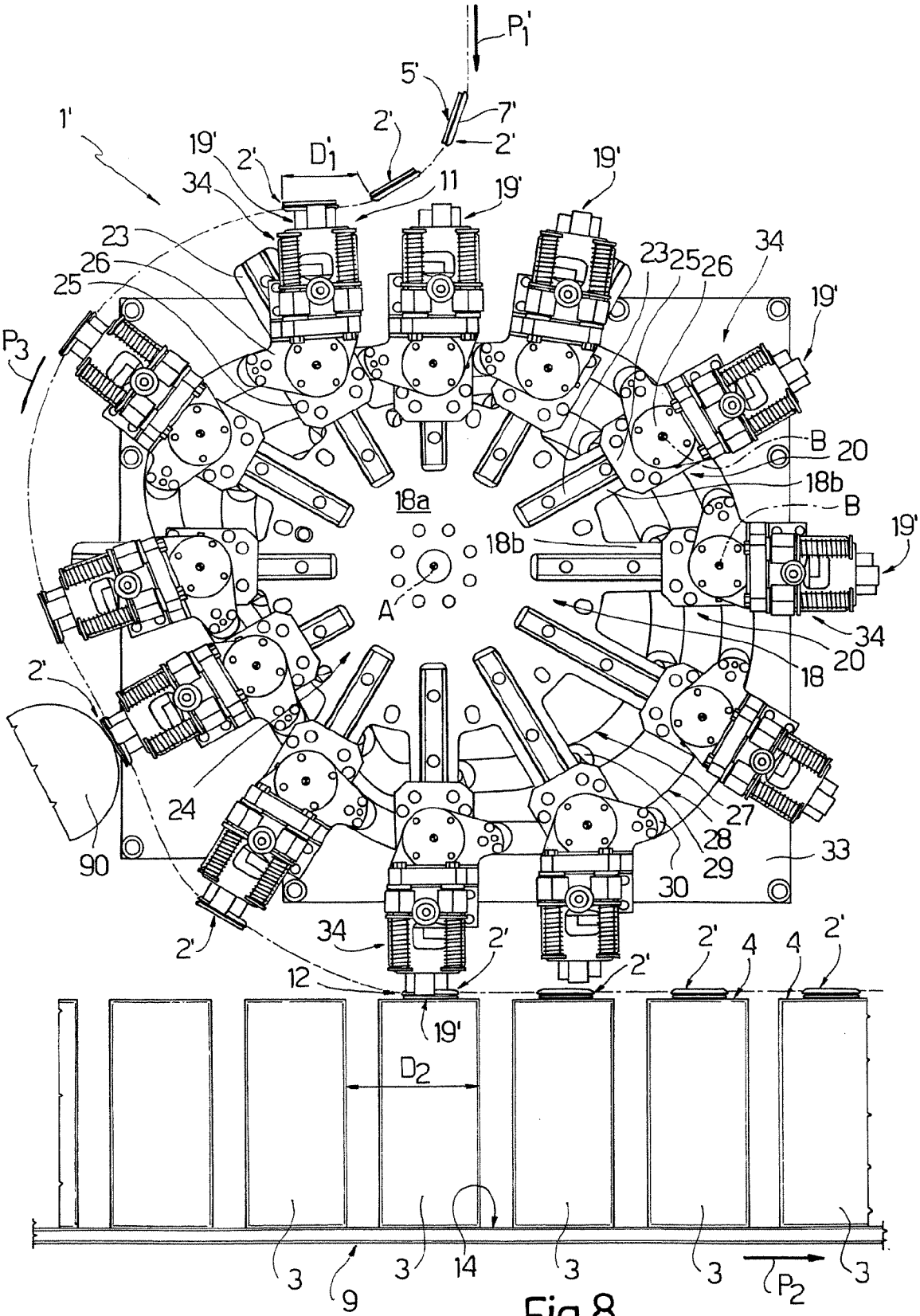
FIG. 8 shows the same view as in FIG. 1, of an alternative embodiment of the unit according to the present invention.
Figure 9:
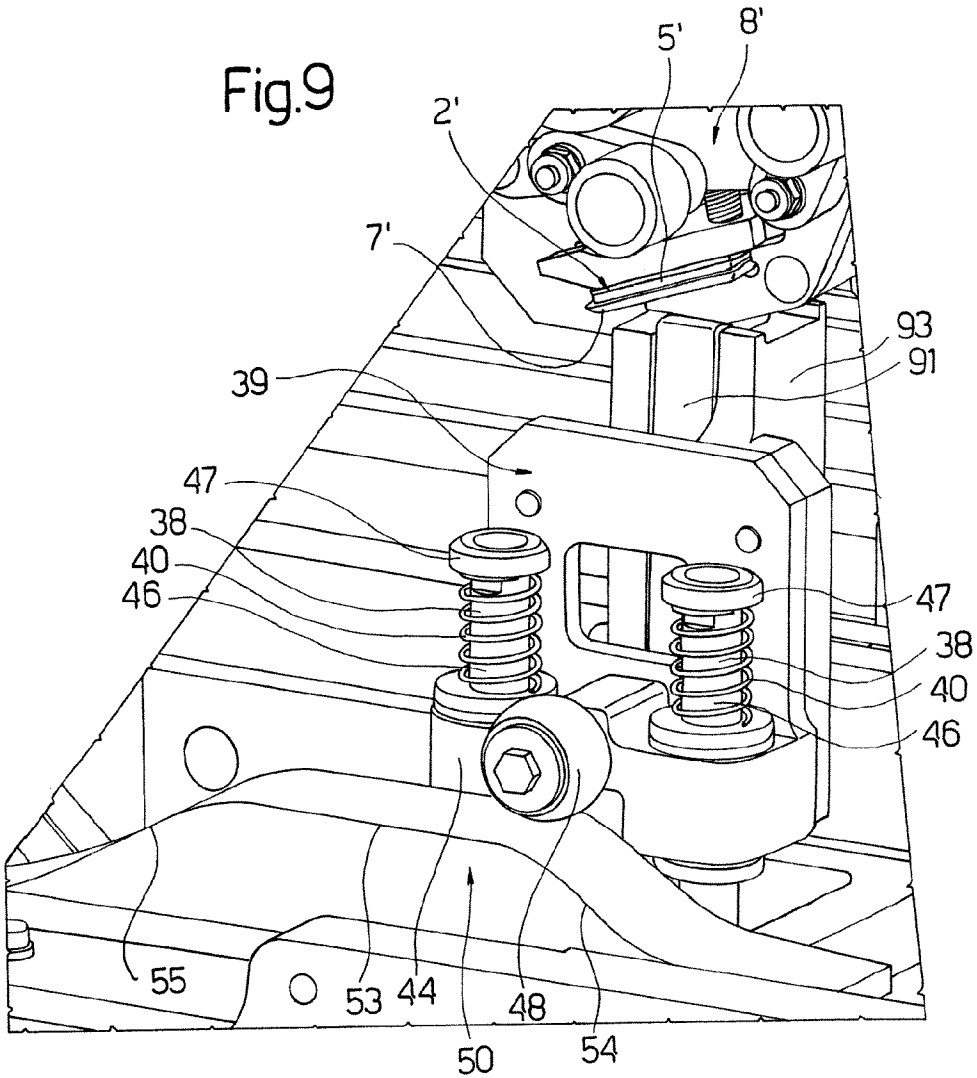
FIG. 9 shows a larger-scale view in perspective of a gripping member of the FIG. 8 unit for feeding a respective opening device to the area of application to a respective package.
Figure 10:
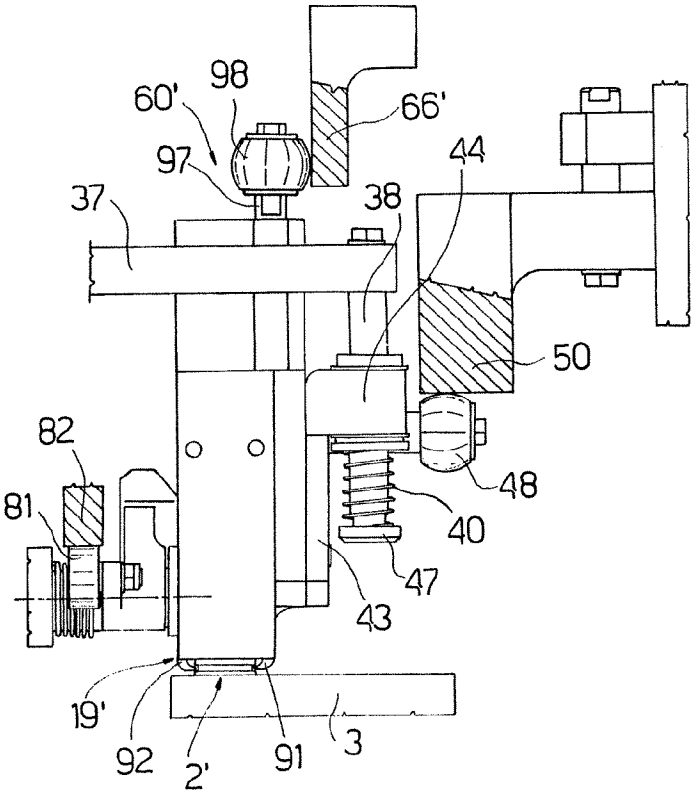
FIG. 10 shows a side view, with parts removed for clarity, of a portion of the FIG. 8 unit.

As shown in FIGS. 8 and 9, opening devices 2' are flat and substantially rectangular, are made of plastic material, and are hinged. Each opening device 2' comprises in known manner a surrounding frame 5' (only shown partly) which is fixed to wall 4 of a respective package 3 and defines a through opening (not shown) by which to pour out the food product; and a cap 7' hinged to frame 5' to close said opening.

Opening devices 2' are fed to unit 1' along a circular path $P_1'$ by a rotary conveyor 8'—step-operated in the example shown; are spaced with a spacing $D_1'$ different from spacing $D_2$ of packages 3; and, to be glued to packages 3, require a relatively small amount of adhesive as compared with that of opening devices 2, and may therefore be coated easily with adhesive using a straightforward coating roller 90.

By virtue of the peripheral speed of opening devices 2' on wheel 18 being controllable by cams 27, 28, a portion of path $P_3$ may advantageously be formed along which opening devices 2' travel at an appropriate constant speed enabling opening devices 2' to be coated with adhesive by sliding over coating roller 90, which is therefore located alongside wheel 18, immediately upstream from application station 12.

Unit 1 is therefore substantially converted to unit 1' by installing coating roller 90 along path $P_3$, replacing gripping members 19 with gripping members 19' designed to interact with opening devices 2', and replacing actuating mechanisms 60 with appropriate actuating mechanisms 60'.

As shown in FIGS. 8-11, each gripping member 19' substantially differs from relative gripping member 19 by comprising two movable jaws 91, 92 for gripping opposite sides of relative opening device 2'.

More specifically, gripping member 19' comprises a substantially parallelepiped-shaped supporting body 93 which, like supporting body 56, is fixed to and projects from main portion 43 of relative fastening body 39, on the opposite side to that from which relative appendix 44 projects. Jaws 91, 92 are defined by elongated bodies extending along opposite sides of supporting body 93, and comprising first end portions 94 adjacent to relative appendix 44 and hinged to supporting body 93 about respective axes D parallel to plate portion 37 of relative frame 34 and perpendicular to axis A; and opposite second end portions 95 located further outwards radially with respect to axis A, and substantially in the form of curved tips with their concavities facing to grip and retain a relative opening device 2'.

Figure 11:
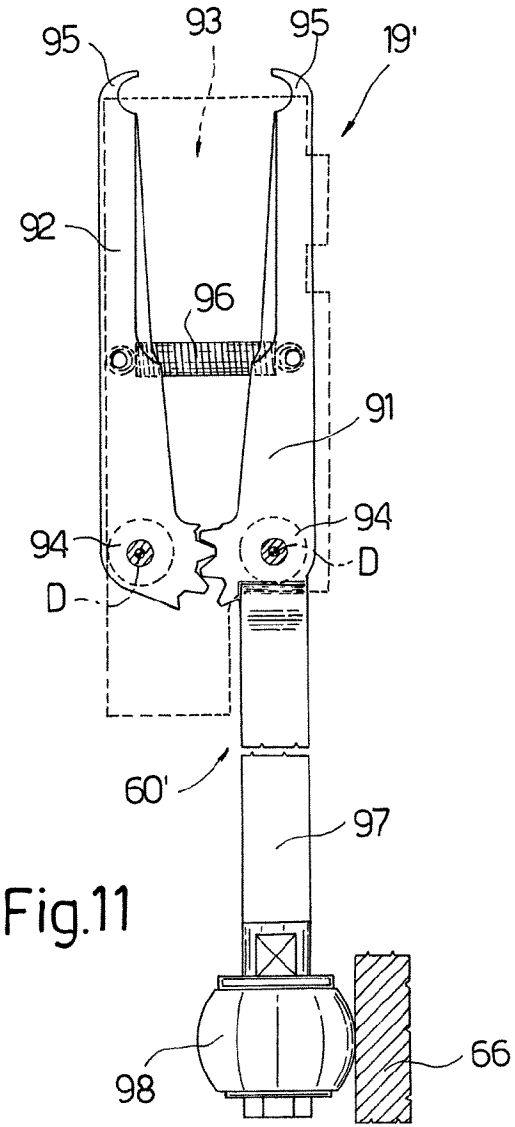
FIG. 11 shows a side view of an actuating mechanism for operating the FIG. 9 gripping member.

As shown in particular in FIG. 11, jaws 91, 92 are loaded elastically towards each other, to define a closed position, by a cylindrical helical spring 96 extending through supporting body 93 in a direction parallel to axis A. End portions 94 of jaws 91, 92 define respective sector gears meshing with each other, and one of which (the one defined by jaw 91) is connected integrally to a lever arm 97 extending from relative axis D, in the opposite direction to relative jaw 91, and fitted with a cam follower roller 98 which cooperates in rolling manner with two fixed cams 66', identical with cams 66, to produce, at respective stations 11 and 12, a parting rotation movement of jaws 91, 92 about respective axes D into an open position enabling engagement and release of relative opening device 2'.

Unit 1' operates in exactly the same way as unit 1, the only difference being that opening devices 2' slide over, and are coated with adhesive by, coating roller 90 upstream from application station 12.

The advantages of units 1, 1' according to the present invention will be clear from the foregoing description.

In particular, units 1, 1' are highly versatile and, with only minor alterations, can operate with different types of opening devices (2, 2'). In fact, given the possibility of adjusting the speed of gripping members 19, 19' as wheel 18 rotates, spacings $D_1$ and $D_2$ with which opening devices 2 and packages 3 are fed to wheel conveyor 10 are in no way dependent, and any necessary operations can be performed as opening devices 2, 2' are conveyed on conveyor wheel 10.

The non-dependence of spacings $D_1$ and $D_2$ with which opening devices 2, 2' and packages 3 are fed to conveyor wheel 10, together with continuous operation of conveyor wheel 10, enables high output speeds to be achieved.

Moreover, controlling the trajectory and speed of gripping members 19, 19' by means of cams 27, 28 minimizes impact between opening devices 2, 2' and relative gripping members 19, 19' at pickup station 11; for which purpose, the peripheral speed of gripping members 19, 19' at station 11 is preferably greater than the speed at which opening devices 2, 2' are fed to station 11.

Finally, positioning wheel 18 vertically, i.e. with axis A positioned horizontally, minimizes the space occupied by unit 1, 1' as a whole, and makes operator access to all the component parts of unit 1, 1' easier.

Clearly, changes may be made to units 1, 1' as described and illustrated herein without, however, departing from the protective scope defined in the accompanying Claims.

In particular, opening devices 2, 2' may be heat sealed to respective packages 3, in which case, the adhesive coating operations would be replaced by heating operations performed, for example, upstream from wheel 18 or along path $P_3$ produced jointly by rotation of wheel 18 and the guiding action of cams 27, 28.

The invention claimed is:

1. A unit for applying opening devices to packages of pourable food products, comprising:

first conveying means for feeding said opening devices successively along a first path;

second conveying means for feeding said packages successively along a second path; and transfer means for transferring said opening devices from a pickup station located along said first path, to an application station for applying the opening devices to respective said packages and located along said second path; said transfer means comprising a wheel rotating about an axis, and at least one gripping member carried by said wheel and for receiving one opening device at a time from said first conveying means, and transferring it to said second path by rotation of said wheel;

said transfer means also comprising connecting means for connecting said gripping member movably to said wheel; and guide means for altering the position of said gripping member with respect to said wheel as the wheel rotates;

said connecting means comprise guide and slide means interposed between said wheel and said gripping member;

said guide and slide means comprise at least one guide member fixed to said wheel radially with respect to said axis; and at least one slide member fitted in sliding manner to said guide member;

said connecting means comprise articulating means between said gripping member and said slide member to permit oscillation of said gripping member about a hinge axis incident with and crosswise to a radial direction of movement of said slide member; and said gripping member is connected to said component part of said articulating means by a supporting frame; and said supporting frame comprises a first portion fixed to said component part, and a second portion fixed to said gripping member and movable with respect to said first portion to increase or reduce a distance between the gripping member and said axis of said wheel in relation to a specific position occupied by said slide member along said guide member.

2. A unit as claimed in claim 1, wherein said guide means comprise cam means for controlling, as said wheel rotates, movements of said gripping member radially with respect to the axis of the wheel, and about said hinge axis.

3. A unit as claimed in claim 2, wherein said cam means comprise two cams extending seamlessly about the axis of said wheel; a first of said cams being engaged in rolling manner by a cam follower integral with said slide member; and a second of said cams being engaged in rolling manner by a cam follower integral with a component part, carried by said gripping member, of said articulating means.

4. A unit as claimed in claim 3, wherein said first and said second cam are carried by fixed supporting means.

5. A unit as claimed in claim 3, wherein said supporting frame comprises elastic means interposed between said first and said second portion to normally keep said first and said second portion in a predetermined relative position corresponding to a minimum said distance from said axis of said wheel in relation to the specific position occupied by said slide member along said guide member; and in that further cam means are provided for increasing said distance, in opposition to said elastic means, at said pickup station and said application station.

6. A unit as claimed in claim 3, wherein said gripping member comprises a main body integral with said second portion of said supporting frame; and at least two jaws which are connected movably to said main body, are loaded elastically towards each other to define a closed position enclosing a relative said opening device, and are movable, at said pickup and application stations and by a lever-and-cam actuating mechanism, into an open position permitting engagement and release of the opening device.

7. A unit as claimed in claim 1, wherein said gripping member is selectable from at least two types of gripping members designed to operate with different types of opening devices.

8. A unit as claimed in claim 1, also comprising pressure means exerting contact pressure between said opening devices and said packages as of said application station and along at least a portion of said second path.

9. A unit as claimed in claim 1, comprising a number of said gripping members connected by respective said articulating means to respective said slide means, which in turn are connected in sliding manner to respective said guide means fixed to said wheel radially about said axis.

10. A unit as claimed in claim 1, wherein, at said pickup station, the traveling speed of said gripping members is greater than the speed at which said opening devices are fed to the pickup station.

11. A unit as claimed in claim 1, wherein the axis of said wheel is horizontal.

12. A unit as claimed in claim 1, wherein said wheel is continuously-operated.

* * * * *